United States Patent [19]

Lee

[11] Patent Number: 4,970,878

[45] Date of Patent: Nov. 20, 1990

[54] JEWELRY MOUNTING STRUCTURE EMPLOYING ROTATABLE DISPLAY MEMBERS

[76] Inventor: Steven D. Lee, 1126 12th Ave., Honolulu, Hi. 96816

[21] Appl. No.: 438,114

[22] Filed: Nov. 20, 1989

[51] Int. Cl.[5] ..... A44C 25/00

[52] U.S. Cl. ..... 63/23; 63/31

[58] Field of Search ..... 63/23, 18, 2, 26, 31, 63/29.1; 40/323, 27.5, 1.5; 206/0.8

[56] References Cited

U.S. PATENT DOCUMENTS

| | | | |
|---|---|---|---|
| D. 256,003 | 7/1980 | Barr | 63/23 X |
| 685,526 | 10/1901 | Perry | 63/23 |
| 915,678 | 3/1909 | Kantor et al. | 63/31 |
| 1,550,011 | 8/1925 | Cobb | 63/31 |
| 2,187,947 | 1/1940 | Marks | 63/23 X |
| 2,585,183 | 2/1952 | Stern | 63/31 X |
| 3,596,380 | 8/1971 | Williams | 63/31 X |
| 4,028,908 | 6/1977 | Michael | 63/31 X |

FOREIGN PATENT DOCUMENTS

| | | | |
|---|---|---|---|
| 739455 | 1/1933 | France | 63/31 |
| 1175386 | 3/1959 | France | 63/31 |
| 1381490 | 11/1964 | France | 63/31 |

*Primary Examiner*—James R. Brittain

*Attorney, Agent, or Firm*—Michael A. Painter

[57] ABSTRACT

The disclosure concerns a jewelry mounting apparatus for pendants, bracelets, rings and the like which incorporates a planar mounting frame adapted to rotate about one or more positional axes for the purpose of displaying opposing surfaces of mounted coins, gems, other ornamental objects and the mounting components. An inner mounting frame has an aperture centrally disposed therethrough. The item to be displayed is mounted within the central aperture of the inner mounting frame. A pair of pivot pins depend outwardly from the outer surface of the inner mounting frame, defining a rotational axis about which the inner mounting frame will rotate. An outer planar mounting frame has an aperture disposed therethrough. A plurality of opposed detents are formed in the surface of the outer frame about the aperture. The location and selection of the pivot detents which are used to engage the pivot pins establishes the axis of rotation of the inner mounting frame relative to the outer frame and for the proper orientation of the mounted coin or other object.

8 Claims, 2 Drawing Sheets

FIG.1a FIG.1c
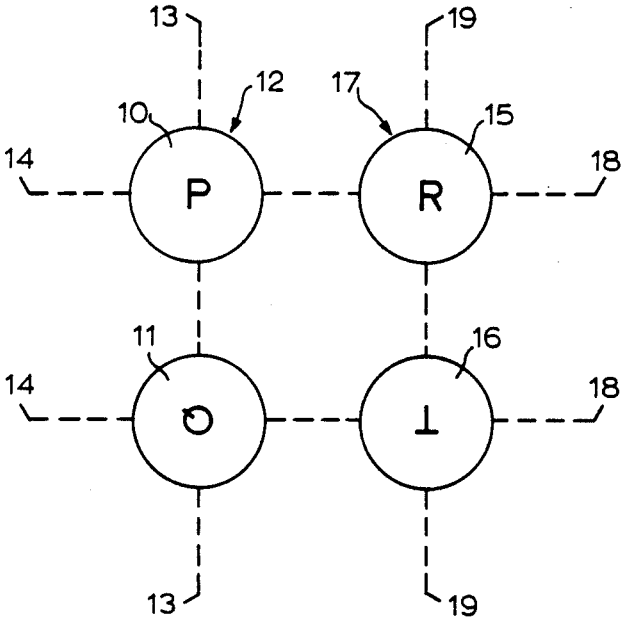
FIG.1b FIG.1d
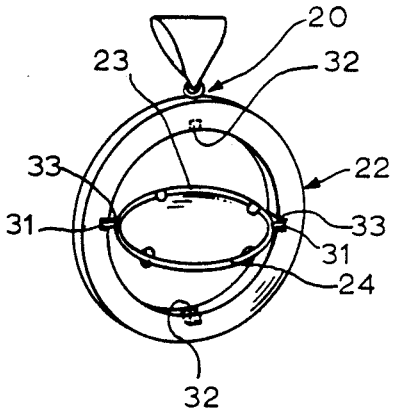
FIG. 2
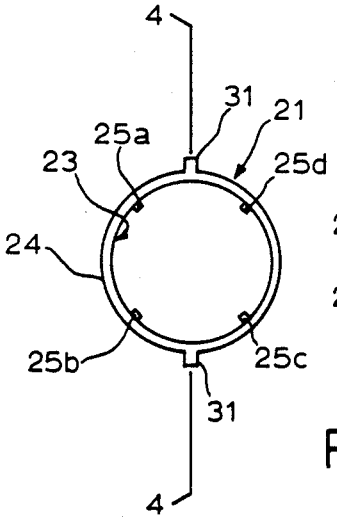
FIG. 3
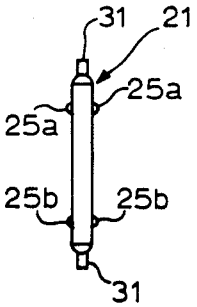
FIG. 4
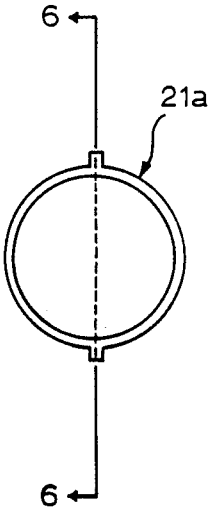
FIG. 5
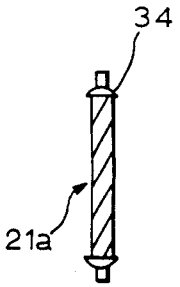
FIG. 6

FIG. 7
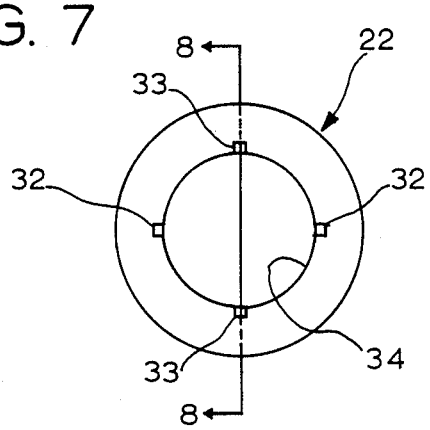
FIG. 8
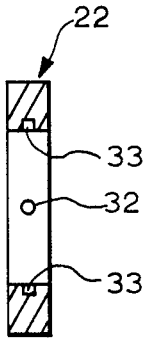
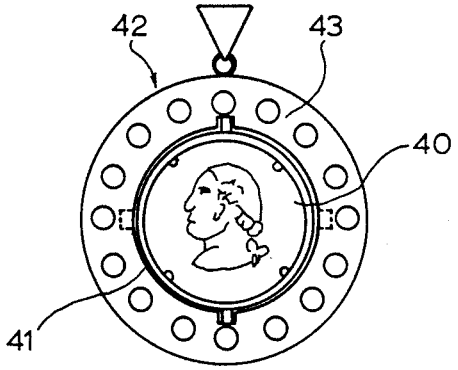
FIG. 9a
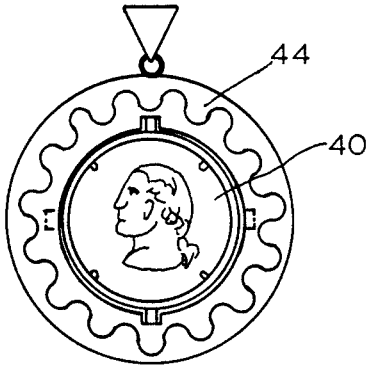
FIG. 9b
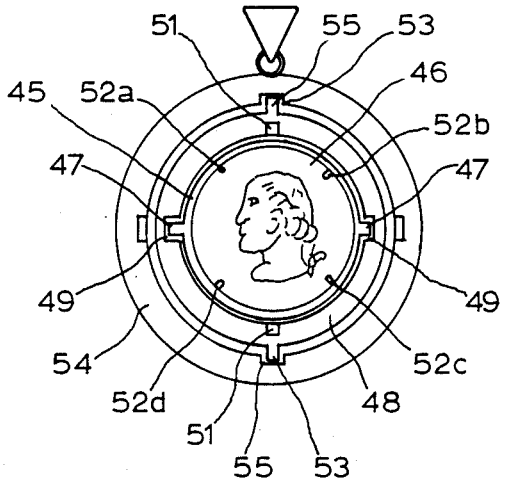
FIG. 10

JEWELRY MOUNTING STRUCTURE EMPLOYING ROTATABLE DISPLAY MEMBERS

BACKGROUNG OF THE INVENTION

1. Field of the Invention.

The present invention generally relates to mounting structures for jewelry, and more particularly, to mounting apparatus used to display multisurface items.

2. Prior Art.

The present invention is a response to the increasing popularity in the use of coins as elements in the design of jewelry. The most significant characteristic of coins minted either as legal tender or for commerative purposes is the use of decorative ornamentation on both obverse and reverse surfaces of the disc. A primary problem which the present invention has sought to solve arises from the differences in the relationship between the ornamentation appearing on the obverse and reverse surfaces. As an example, the ornamentation appearing on the obverse and reverse surfaces of United States coins are positioned in an opposed relationship. The coin must typically be rotated from top to bottom (i.e., about a horizontal axis of rotation) in order to view both surfaces in their intended orientation. On the other hand, commemorative coins are generally minted with the ornamentation on the obverse and reverse surfaces being positionally aligned with one another. To view both surfaces in a proper manner, the coin must be rotated about a vertical axis.

The devices disclosed by the prior art are inadequate. The most elemental form employs a fixed frame about the item and requires a full reversal of the set item and mounting in order to display both the obverse and reverse surfaces. Although this might be adequate for some forms of jewelry, it cannot be adapted to jewelry having specific positional display requirements. Another device taught by the prior art comprises a reversible ring mounting having an open frame for receiving an item to be displayed. The device disclosed by the prior art does not address the problems inherent in items such as pendants requiring specific display positions nor does it provide for altering the ornamentation disposed on a given side of the setting while maintaining the proper design orientation.

The present invention substantially resolves the problems which are inherent in the devices taught by the prior art. For use with coins, a planar inner mounting frame has a circular aperture therethrough having a diameter which is adapted to receive the coin. The coin is properly oriented and mounted in a setting. The setting is comprised of a circular band with aligned sets of mounting prongs depending radially inwardly from the surface defining the aperture, each aligned set of mounting prongs being spaced to firmly contact the opposing surfaces of the disc. If a double bezel setting is employed, the edges of the cylindrical setting extend inwardly over the outer edges of the obverse and reverse surfaces of the coin. Coins or discs of equal diameter can be interchangeably mounted. A pair of diametrically opposed pivot pins depend outwardly from the outer surface of the inner frame. An outer mounting frame has a circular aperture disposed therethrough which is adapted to receive the inner frame. A plurality of detents are aligned to engage the pivot pins. Each pair of diametrically opposed pivot detents provides a unique axis of rotation for the inner frame when engaged with the pivot pins of the inner frame.

SUMMARY OF THE INVENTION

The present invention comprises jewelry mounting apparatus adapted to reversibly display the opposed surfaces of items having symmetrical shapes such as coins, discs and rectangles which have ornamented obverse and reverse surfaces. For displaying a coin, a planar inner mounting frame is circular and is defined by the inner and outer diameters. The diameter of the inner surface is specifically adapted to the size of the item to be displayed. A setting comprises either resilient pairs of mounting prongs or a double bezel which extend inwardly from the inner surface of the inner frame to secure the coin therebetween. A pair of diametrically opposed pivot pins depend outwardly from the outer surface of the inner mounting frame, providing the inner mounting frame with an axis of rotation. An outer mounting frame has an aperture disposed therethrough which is adapted to receive the inner mounting frame. The pivot pins engage a selected pair of opposed detents selectively spaced about the inner surface of the outer mounting frame. When the frames are coupled, each pivot pin is in forced engagement with a detent. When a coin is mounted within the inner frame, it reinforces the inner frame making it no longer resilient but rigid, thus preventing the pivot pins from inadvertently disengaging from the pivot detents formed in the outer frame.

One or more intermediate frames may be employed to provide additional axes of rotation and additional surface area for ornamental purposes. The surfaces of an intermediate frame will be defined by their inner and outer diameters. Pairs of opposed detents are formed about the inner surface for engagement with the pivot pins depending outwardly from the inner frame. In a like manner, a pair of opposed pivot pins depend outwardly from the outer surface of the intermediate frame for engagement with receiving detents formed in the outer frame. By positioning the diametrically opposed pivot detents formed in the inner surface perpendicular to the diametrically opposed pivot pins extending outwardly from the outer surface of the intermediate frame, the coin may be rotated about both horizontal and vertical axes relative to the outer mounting frame. This allows items such as United States coins to be properly oriented when viewed from either side of the outer mounting frame, providing four different combinations of design surfaces of the coin and the outer mounting frame.

It is therefore an object of the present invention to provide an improved jewelry mounting apparatus for displaying opposed surfaces of an object.

It is another object of the present invention to provide a jewelry mounting which can display opposed surfaces of a coin independent of the orientation of the illustrated works.

It is still another object of the present invention to provide a jewelry mounting which can display opposed surfaces of the mounting structure while maintaining the proper orientation of the displayed object.

It is still yet another object of the present invention to provide an improved jewelry mounting apparatus having a plurality of rotational axes to display the opposed surfaces of a mounted item.

It is still yet another object of the present invention to provide a rotational jewelry mounting to exhibit coins and other symmetrical items which is inexpensive and simple to fabricate.

The novel features which are believed to be characteristic of the invention, both as to its organization and method of operation, together with further objectives and advantages thereof, will be better understood from the following description considered in connection with the accompanying drawings in which a presently preferred embodiment of the invention are illustrated by way of example. It is to be expressly understood, however, that the drawings are for the purpose of illustration and description only, and is not intended as a definition of the limits of the invention.

BRIEF DESCRIPTION OF THE DRAWING

FIGS. 1*a* and 1*b* a coin having opposed ornamentation on the observe and reverse surfaces, respectively.

FIGS. 1*c* and 1*d* illustrate a coin having aligned ornamentation on the observe and reverse surfaces, respectively.

FIG. 2 is a perspective view of a pendant in accordance with the present invention illustrating the inner mounting frame partially rotated about on axis of rotation.

FIG. 3 is a plan view of the inner mounting frame in accordance with the present invention utilizing double ended setting prongs.

FIG. 4 is a cross-sectional view of the inner mounting frame utilizing double ended prongs of FIG. 3 taken through line 4—4 of FIG. 3.

FIG. 5 is a plan view of an inner mounting frame in accordance with the present invention utilizing a double-sided bezel.

FIG. 6 is a cross-sectional view of the inner mounting frame of FIG. 5 taken through line 6—6 of FIG. 5.

FIG. 7 is a plan view of an outer amounting frame in accordance with the present invention.

FIG. 8 is a cross-sectional view of the outer mounting frame of FIG. 7 taken through line 8—8 of FIG. 7.

FIGS. 9*a* and 9*b* illustrate opposed ornamented surfaces of the outer mounting frame.

FIG. 10 illustrates an alternative embodiment of the present invention employing an intermediate mounting frame.

DESCRIPTION OF THE PRESENTLY PREFERRED EMBODIMENT

The present invention comprises a mounting for jewelry used to display substantially planar items having ornamentation on the opposed surfaces. Although the description of the present invention relates to its use to display coins, it would be obvious to one having skill in the art that the invention can be used with other planar items having a symmetrical geometry.

The present invention is a response to the increasing popularity of fashion jewelry incorporating coins or other artistically decorated discs. One of the primary characteristics of the coins is the use of artistic ornamentation on both the obverse and reverse surfaces of the coins. The variations in coin ornamentation creates a problem which is solved by the present invention and can be best understood by reference to FIGS. 1*a*–1*d*, inclusive.

FIG. 1*a* and FIG. 1*b* illustrate the positionally opposed surface orientation of the obverse surface 10 and reverse surface 11, respectively, of coin 12. The letter "P" on obverse surface 10 is in the proper position for viewing. In FIG. 1*b*, the letter "Q" would be improperly positioned if coin 12 was rotated about its vertical axis 13. Where a coin exhibits opposed orientation, in order for both surfaces 10 and 11 to be properly oriented for viewing, it must be rotated about a horizontal axis of rotation 14.

FIG. 1*c* and FIG. 1*d* illustrate the obverse surface 15 and reverse surface 16, respectively, of coin 17, the ornamentation being oriented in an aligned format. Letter "R" on the obverse surface 15 is in proper position for viewing. If coin 17 was rotated about its horizonatal axis 18, the letter "T" appearing on the obverse surface 16 would be improperly oriented. In order to be able to properly view both the obverse and reverse surfaces 15 and 16 of coin 17, it must be rotated about its vertical axis 19.

A primary object of the present invention is to permit the mounting of coins having either opposing or aligned ornamentation and to provide the ability to rotate the coin and properly orient the obverse and reverse surfaces for viewing. The preferred embodiment of the present invention can be best seen by reference to FIG. 2. Although FIG. 2 illustrates the structure of the present invention incorporated in a pendant, it is equally applicable to other forms of jewelry such as rings, bracelets and the like.

In FIG. 2, pendant 20 employs an inner mounting frame 21 which is shown in enlarged detail in FIG. 4. Inner mounting frame 21 comprises a planar circular band defined by the diameters of inner surface 23 and outer surface 24. At the time of assembly, the coin to be displayed is coupled within the aperture defined by the circumference of surface 23. As shown in FIGS. 3*a* and 3*b*, the setting comprises aligned pairs of mounting prongs 25*a*–25*d*, inclusive, which depend inwardly from surface 23, the spacing between the prongs of each aligned pair being defined by the thickness of inner mounting frame 21 which is approximately the thickness of the coin to be displayed.

It is an object of the present invention to permit the coin to be mounted for display in a manner which is independent of the orientation of surface ornamentation. Inner mounting frame 21 must be sufficiently strong to secure the coin. The resilience inherent in gold or silver will permit the inner frame 21 to be sufficiently compressed along its diameter to enable pivot pins 31 to be engaged within a selected pair of pivot detents 32 or 33 formed in the outer mounting frame 22 without permanently deforming inner frame 21. Since the strength of the combined structure comprised of the coin and inner mounting frame 21 will be substantially greater than the frame itself, the thickness of inner mounting frame 21 can be minimized to achieve the defined artistic objective yet be very secure once a coin is mounted.

An alternative embodiment of an inner mounting frame can be best seen by reference to FIG. 5 and FIG. 6, the inner mounting frame being designated by the reference numeral 21*a*. In this embodiment, mounting prongs 25*a*–25*d*, inclusive, are replaced by a structure conventionally known as a double bezel. In a double bezel, the inner surface 23*a* forms the concave surface 34 covering the obverse and reverse edges of the mounted coin.

As stated, an objective of the present invention is to provide the ability to rotate the mounted coin in order that both the obverse or reverse surfaces can be properly displayed. In FIG. 2, inner mounting frame 21 is shown in a partially rotated position relative to outer mounting frame 22. As can be seen in FIG. 3, diametrically opposed pivot pins 31 depend outwardly from outer surface 24 and proscribe an axis of rotation of inner mounting frame 21. In relation to FIG. 1*a*, the vertical axis 13 would be equivalent to that defined by pivot pins 31. Although FIG. 2 illustrates only one axis of rotation, it is understood this could be increased merely by the rotation of the inner frame relative to the outer frame whereby the pivot pins would engage properly placed pivot detents in the outer mounting frame.

The inner mounting frame 21 shown in FIG. 2 is coupled to outer mounting frame 22 through the use of a force engaged catch comprised of pivot pins 31 and receiving detents 32 or 33 formed in surface 34 of the outer mounting frame 22 shown in detail in FIG. 7 and FIG. 8. Inner surface 34 defines a circular aperture which is concentric with the outer surface 24 of inner mounting frame 21. Detents 32 and 33 comprise defined depressions in surface 34 which are in alignment with and are adapted to alternatively accept forced engagement with pivot pins 31. Each set of diametrically opposed pivot detents provides an axis of rotation about which inner mounting frame can be rotated. The inner mounting frame 21 is constructed of conventional materials having sufficient elasticity to permit temporary deformation of the material without any permanent set. As will be further defined hereinbelow, where one or more intermediate frames are employed, the outer mounting frames may be constructed of materials which will permit temporary deformation thereof.

To rotate inner mounting frame 21, rotation about a selected axis of rotation requires only that force be applied to the outer edges of inner mounting frame 21 perpendicular to the selected axis. In the example shown in FIG. 2, by applying rotational force to the outer surface of inner mounting frame 21, the frame and mounted coin are rotated about the axis defined by pivot pins 31 and detents 33. By properly positioning a coin within inner mounting frame 21 and selecting the proper pair of pivot detents 32 or 33 formed in the outer mounting frame 22, this will provide the present invention the ability to display the opposed surfaces of coins, discs or the like in the proper positional orientation relative to the outer mounting components.

As shown in FIGS. 9*a* and 9*b*, the present invention also enables the outer ornamental mounting to be rotated about a given surface of a coin enabling the user to change the appearance of the coin's ornamental outer frame while maintaining the proper orientation of the coin. An example of a finished form of the present invention can be best seen by reference to FIG. 9*a* and FIG. 9*b* which illustrate a mounted coin 40. Coin 40 is mounted within an inner frame 41 constructed in accordance with the embodiment shown in FIGS. 3 and 4. The inner frame 41 and outer frame 42 are in accordance with the embodiment shown in FIG. 2. As stated, the obverse surface 43 and reverse surface 44 exhibit different ornamentation when compared to a given surface of coin 40.

FIG. 10 illustrates an alternative embodiment of the present invention employing multiple, concentric mounting frames. This form of the present invention can be used where the proper viewing positions requires additional axes of rotation which may or may not be perpendicular to each other and in cases where additional axes or combinations of surfaces are desirable for positioning or esthetic purposes. In FIG. 10, an inner mounting frame 45 is used as the setting for the displayed item 46. Inner mounting frame 45 utilizes aligned pairs of mounting prongs 52*a*–52*d*, inclusive, which are substantially the same as those described with respect to the structure shown in FIG. 3 and FIG. 4.

As shown in FIG. 10, inner mounting frame 45 has a pair of diametrically opposed pivot pins 47 extending outwardly therefrom. An intermediate rotation frame 48 provides for alternate axes of rotation. Intermediate rotation frame 48 has an inner surface within which is disposed a plurality of pairs of opposed receiving detents. In FIG. 10, pivot pins 47 of inner mounting frame 45 are engaged with detents 49. As with the embodiment shown in FIG. 2, intermediate rotation frame 48 is provided with an alternative set of engageable detents 51 which provide an additional axes of rotation. A pair of pivot pins 53 diametrically extend outwardly from the outer surface of intermediate rotation frame 48. Outer mounting frame 54 is constructed in the same form as shown in FIG. 7 and FIG. 8. Pivot pins 53 of intermediate rotation frame 48 are shown in forced engagement with detents 55 in outer mounting frame 54. The alternative pair of detents provide an additional axes of rotation for intermediate rotation frame 48.

I claim:

1. An apparatus for mounting and displaying a circular disk having ornamented obverse and reverse faces in parallel space relation comprising:

(a) a cylindrical first mounting frame having inner and outer surfaces bounded by parallel top and bottom surfaces, the inner surface being adapted to receive and uniformly circumscribe the disk, the top and bottom surfaces of the first mounting frame being in a planar relationship to the obverse and reverse surfaces of the disk;

(b) setting means for coupling the disk to the first mounting frame, said setting means being coupled to the top and bottom surfaces of the first mounting frame at the inner surface thereof;

(c) an intermediate rotation frame having a top and bottom surface and concentric inner and outer cylindrical surfaces, the inner cylindrical surface being adapted to uniformly circumscribe and be equally spaced from the outer surface of the first mounting frame;

(d) a first pivot assembly coupled intermediate said first mounting frame and said intermediate rotation frame comprising:

(i) a pair of pivot pins extending outwardly from the outer surface of the cylindrical first mounting frame in diametric opposition to each other, said pivot pins defining an axis of rotation along the diameter of the cylindrical first mounting frame; and (ii) at least two sets of detents formed in the inner cylindrical surface of the intermediate rotation frame, each set consisting of two detents in axial opposition to one another and being adapted to be in forced engagement with the pivot pin of said first pivot assembly to define a unique axis of rotation about which the cylindrical first mounting frame is rotatable;

(e) a second mounting frame having a top and bottom surface and a cylindrical aperture disposed therethrough defining an aperture surface, the axis of the cylindrical aperture being perpendicular to the top and bottom surfaces, the aperture surface being adapted to circumscribe and be spaced from the outer surface of said intermediate rotation frame; and (f) a second pivot assembly coupling said second mounting frame and intermediate rotation frame comprising:

(i) a pair of pivot pins extending radially outwardly from the outer cylindrical surface of the intermediate rotation frame in diametric opposition to each other, said pivot pins defining an axis of rotation along the diameter of the intermediate rotation frame; and (ii) at least two sets of detents formed in the aperture surface of the second mounting frame, each set consisting of two detents in axial opposition to one another and being adapted to be in forced engagement with said pivot pins to define a unique axis of rotation about which the intermediate rotation frame is rotatable.

2. An apparatus for mounting and displaying a circular disc having ornamental obverse and reverse faces as defined in claim 1 wherein said setting means comprises a plurality of pairs of mounting prongs, one prong of each pair being coupled to the top and bottom surfaces, respectively, of said first mounting frame.

3. An apparatus for mounting and displaying a circular disc having ornamented obverse and reverse faces in parallel spaced relation as defined in claim 1 wherein said setting means comprises a double bezel secured about said cylindrical first mounting frame at the top and bottom surfaces thereof.

4. An apparatus for mounting and displaying the ornamented obverse and reverse surfaces of a planar work comprising:

(a) a first mounting frame comprising a planar member having a parallel top and bottom surfaces and an aperture disposed therethrough between the top and bottom surfaces and being adapted to receive and circumscribe the planar work;

(b) setting means for coupling the planar work to the first mounting frame, said setting means being coupled to the top and bottom surfaces of the first mounting frame at the aperture disposed therethrough whereby the planar work is coupled to and is circumscribed within the aperture in the first mounting frame;

(c) a second mounting frame having top and bottom surfaces in a planar relationship to the top and bottom surfaces of the first mounting frame, and an aperture disposed therethrough defining an aperture surface, the aperture surface being adapted to circumscribe the first mounting frame;

(d) a pair of pivot pins depending outwardly from said first mounting frame, said pins lying along a common axis in the plane of said first mounting frame; and (e) a plurality of aligned pairs of detents disposed in the aperture surface of said second mounting frame adjacent the top surface thereof, each of said pairs of aligned detents lying along a separate axis all of which are in the plane of said second mounting frame whereby separate axes of rotation are provided about which said first mounting frame is pivotable.

5. An apparatus for mounting and displaying the ornamental obverse and reverse surfaces of a planar work as defined in claim 4 wherein said setting means comprises a plurality of pairs of mounting prongs, one prong of each pair being coupled to the top and bottom surfaces respectively of said first mounting frame.

6. An apparatus for mounting and displaying the ornamental obverse and reverse surfaces of a planar work as defined in claim 4 wherein said setting means comprises a double bezel coupled about said first mounting frame at the top and bottom surfaces thereof.

7. An apparatus for mounting and displaying a circular disk having ornamented obverse and reverse faces in parallel spaced relation comprising:

(a) a cylindrical first mounting frame having inner and outer surfaces bounded by parallel top and bottom surfaces, the inner surface being adapted to receive and uniformly circumscribe the disk, the top and bottom surfaces of the first mounting frame being in a planar relationship to the obverse and reverse surfaces of the disk;

(b) setting means for coupling the disk to the first mounting frame within the inner cylindrical surface, said setting means comprising pairs of aligned mounting prongs depending radially inwardly from the inner cylindrical surface of the first mounting frame;

(c) a second mounting frame having a top surface and a cylindrical aperture disposed therethrough and defining an aperture surface, the axis of the cylindrical aperture being perpendicular to the top surface, the aperture surface being adapted to circumscribe and be spaced from the outer surface of the first mounting frame;

(d) an engagement assembly for rotatably coupling the first mounting frame to the second mounting frame comprising:

(i) a pair of pivot pins extending radially outwardly from the outer surface of the first mounting frame in diametric opposition to each other, said pivot pins defining an axis of rotation along the diameter of the first mounting frame; and (ii) at least two sets of detents formed in the aperture surface of the second mounting frame, each set consisting of two detents in axial opposition to one another and being adapted to be in forced engagement with said pivot pins to define a unique axis of rotation about which the first mounting frame is rotatable.

8. An apparatus for mounting and displaying a circular disk as defined in claim 7 wherein said engagement assembly further includes an intermediate rotation frame rotationally coupled intermediate said first mounting frame and said second mounting frame.

* * * * *